United States Patent [19]

Farese et al.

[11] Patent Number: 4,616,395

[45] Date of Patent: Oct. 14, 1986

[54] RAILROAD TRACK FIXATION METHOD AND APPARATUS

[75] Inventors: Virgil A. Farese, Framingham; Fred C. Grover, West Rox.; Steve R. Moore, Woburn; Robert W. Gilfillan, Framingham, all of Mass.

[73] Assignee: Perini Corporation, Framingham, Mass.

[21] Appl. No.: 510,087

[22] Filed: Jun. 30, 1983

[51] Int. Cl.[4] ..... B23Q 3/00; E01B 3/28

[52] U.S. Cl. ..... 29/460; 29/526 R; 29/464; 238/7; 238/283; 249/86; 264/33; 264/35

[58] Field of Search ..... 238/2, 6, 7, 83, 84, 238/25, 115, 283; 249/83, 86, 91, 93; 403/118, 43–48; 264/33, 35; 29/460, 464, 526

[56] References Cited

U.S. PATENT DOCUMENTS

| | | | |
|---|---|---|---|
| 2,725,210 | 11/1955 | Swartz | 403/118 X |
| 3,662,952 | 5/1972 | Berks et al. | 238/84 X |
| 3,790,078 | 2/1974 | Egerbork et al. | 238/283 X |
| 3,912,218 | 10/1975 | Lister | 249/93 X |

FOREIGN PATENT DOCUMENTS

| | | | |
|---|---|---|---|
| 2354960 | 5/1975 | Fed. Rep. of Germany | 238/7 |

*Primary Examiner*—Robert B. Reeves
*Assistant Examiner*—Glenn B. Foster

[57] ABSTRACT

A method and apparatus for laying a railroad track includes laying, in tandem, a series of pre-cast concrete slabs on a prepared track bed, the slabs being isolated from the bed, and from each other, by rubber isolation pads, and the slabs having cavities formed on the top faces. The rails are held above the slabs, in their proper location, by removable gauge beams having adjustment means to exactly locate the rails. Before filling the cavities with concrete the shoulder-pins, used to secure the rails, are located with their pin portions in the cavities by being removably secured to templates. The templates are held suspended above the slabs by being removably attached to a rail. The rails are used as guides after setting their exact gauge (separation), elevation and cant (angle of inclination) on the gauge beams, to determine the positions of the templates and shoulder-pins. The cavities are filled to the level of the templates with concrete and, after the concrete hardens, the rails are lifted, the templates are removed and rails are lowered into place.

7 Claims, 15 Drawing Figures

FIG. 6
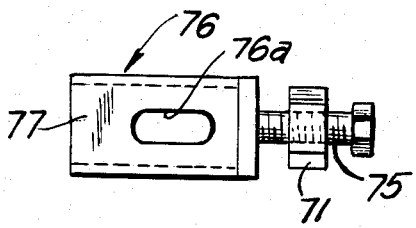
FIG. 7
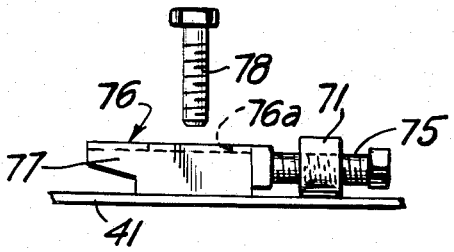
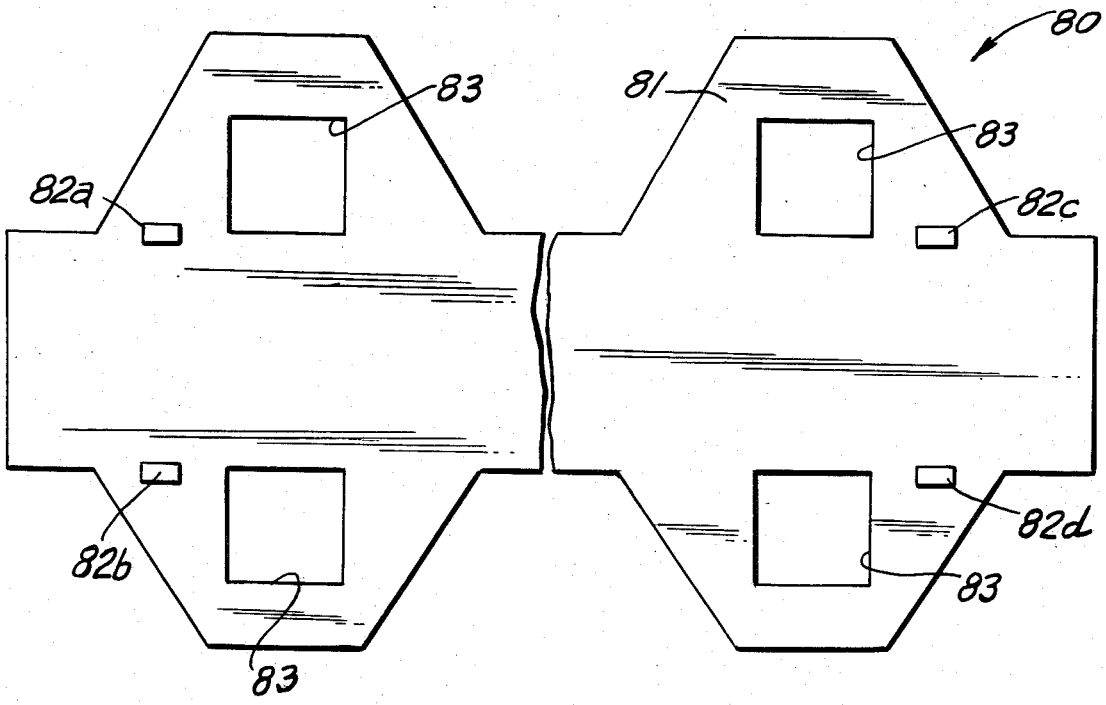
FIG. 8

RAILROAD TRACK FIXATION METHOD AND APPARATUS

BACKGROUND OF THE INVENTION

The present invention relates to a method and apparatus used to lay railroad track and more particularly to such a method and apparatus used to lay the track on concrete supports.

The field of laying tracks for railroads is one of the oldest and most highly developed of the industrial arts. The most widely used method of railroad track laying, and one which is still practiced, involves forming a railroad right-of-way, for example, an earthenwork embankment, upon which is laid a top layer of gravel or stones. A series of parallel chemically impregnated wooden railroad ties are laid on the gravel and perpendicular to the direction of the steel rails. The ties are partially buried in additional gravel or stones. The rails are lowered into the ties and held in place by railroad spikes which are driven into the wooden ties. The spike's head has an elongated portion which overlaps the bottom flange of the railroad track.

In recent years there has been increased emphasis on the use of concrete railroad ties. Such ties are particularly useful in areas in which there is little or no wood and are generally considered to be superior to wooden ties for use on heavily travelled routes and high-speed tracks.

One type of system used to removably fasten the railroad track to a concrete tie is known as the "Sidewinder" system, a trademark of Portec Inc., Oak Brook, Illinois. In that system a "shoulder-pin" fixation member has an elongated pin (rod) portion with indentations and is adapted to be held in the concrete. A shoulder portion sits on top of the concrete tie and has a three-point suspension system. A strong metal clip, which is a unitary member acting as a series of torsion and bending springs, fits in a hole through the shoulder and an indentation in the shoulder, with one of its arms acting against the flange of the railroad track. An external insulated plate may be used between the clip and the tie and a resilient rubber pad may be used between the bottom of the steel railroad track and the top of the concrete tie.

In addition, it has been suggested that, instead of using individual ties, larger pre-cast concrete slabs may be used to support the rails. It has also been suggested that such concrete slabs may be insulated from the road bed by resilient rubber isolation pads to provide damping of noise and vibration.

OBJECTIVES AND FEATURES OF THE INVENTION

It is an object of the present invention to provide a method and apparatus for the laying of railroad tracks which provides an accurate distance between the tracks (gauge) and an accurate inclination of the track from an imaginary horizontal plane (cant).

It is a further object of the present invention to provide such a method and apparatus in which the tracks may be laid without using highly skilled personnel to operate intricate and expensive measuring devices, such as laser devices, in which the tracks may be laid relatively rapidly and which will, with time, maintain the tracks in their gauge and cant.

It is a feature of the present invention to provide a method of laying the parallel rails for a railroad track on an elongated road bed. A series of pre-formed concrete slabs are laid along the track bed. Each of the slabs has a bottom face, facing the track bed, and a top face with at least one cavity.

A series of elongated gauge beams are positioned above the level of the slabs. Each gauge beam is adapted to temporarily hold a pair of rails at the proper gauge, elevation and cant relative to the slab on which it is located. The gauge beams are aligned across the direction of the rails.

A pair of rails are held in the series of gauge beams and the rails are adjusted to the proper gauge, elevation and cant by gauge beam adjustment means. A metal plate template is removably fastened on the rail and track-holding shoulder-pins are removably attached to the template, with the pin portions of the shoulder-pins within the slab cavity.

Concrete is poured into each cavity up to the level of the bottom face of the template, to securely hold the pin portions, and the concrete is hardened. The rails are lifted, the templates are removed, and the gauge beams are removed. Then the rails are lowered. Spring means (spring clips) are fastened to the shoulder portions of each shoulder-pin to hold the rails securely to the slabs.

BRIEF DESCRIPTION OF THE DRAWINGS

Other objectives and features of the present invention will be apparent from the following detailed description, which should be taken in conjunction with the accompanying drawings, in which:

FIG. 6 is a top plan view of the gauge beam adjustment assembly;

FIG. 7 is a side plan view of the gauge beam adjustment assembly of FIG. 6;

FIG. 8 is a top plan view of the template;

DETAILED DESCRIPTION OF THE INVENTION

Figure 1:
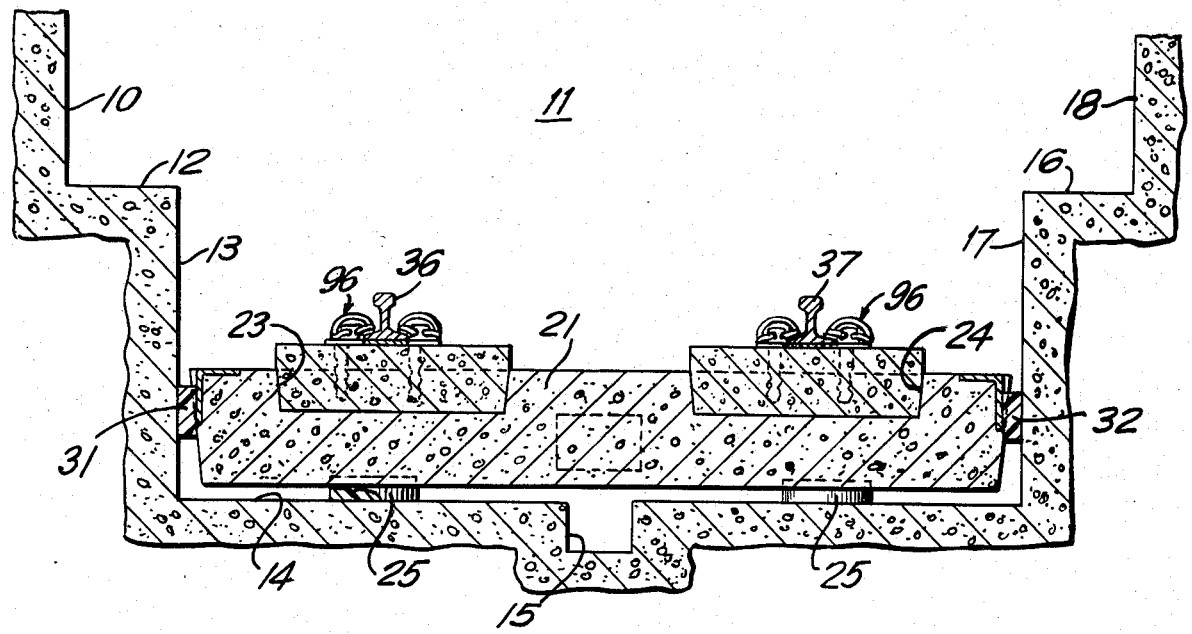
FIG. 1 is a cross-sectional view of the environment of a railroad track in a tunnel, after the rails have been laid in accordance with this invention.

As shown in FIG. 1, the present invention is illustrated in the environment of a subway tunnel which is tunneled through the ground to receive a single-track railroad. However, it will be understood that, although the present invention is described in such an environment, it may be used in other environments such as a railroad track through open countryside or a double-track laid in a tunnel.

The interior sidewall 10 of the single-track subway tunnel 11 terminates in a horizontally aligned walkway 12. A vertically aligned walkway sidewall 13 terminates at the tunnel floor 14 which has an undercut drain 15. A raceway 16 having its vertical sidewall 17 is positioned opposite the walkway 12 and leads to the wall 18 which is parallel with and opposite the tunnel wall 10.

Figure 2:
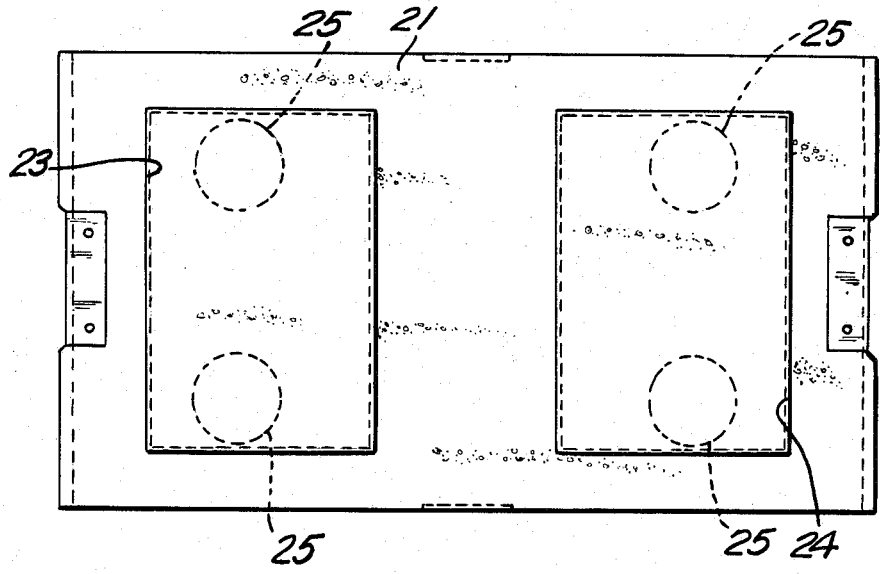
FIG. 2 is a top plan view of a pre-cast concrete slab and FIG. 2*a* is side plan view of the slab shown in FIG. 2.
Figure 2A:
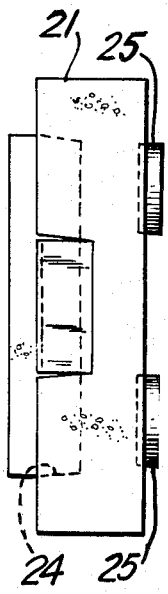
Figure 3:
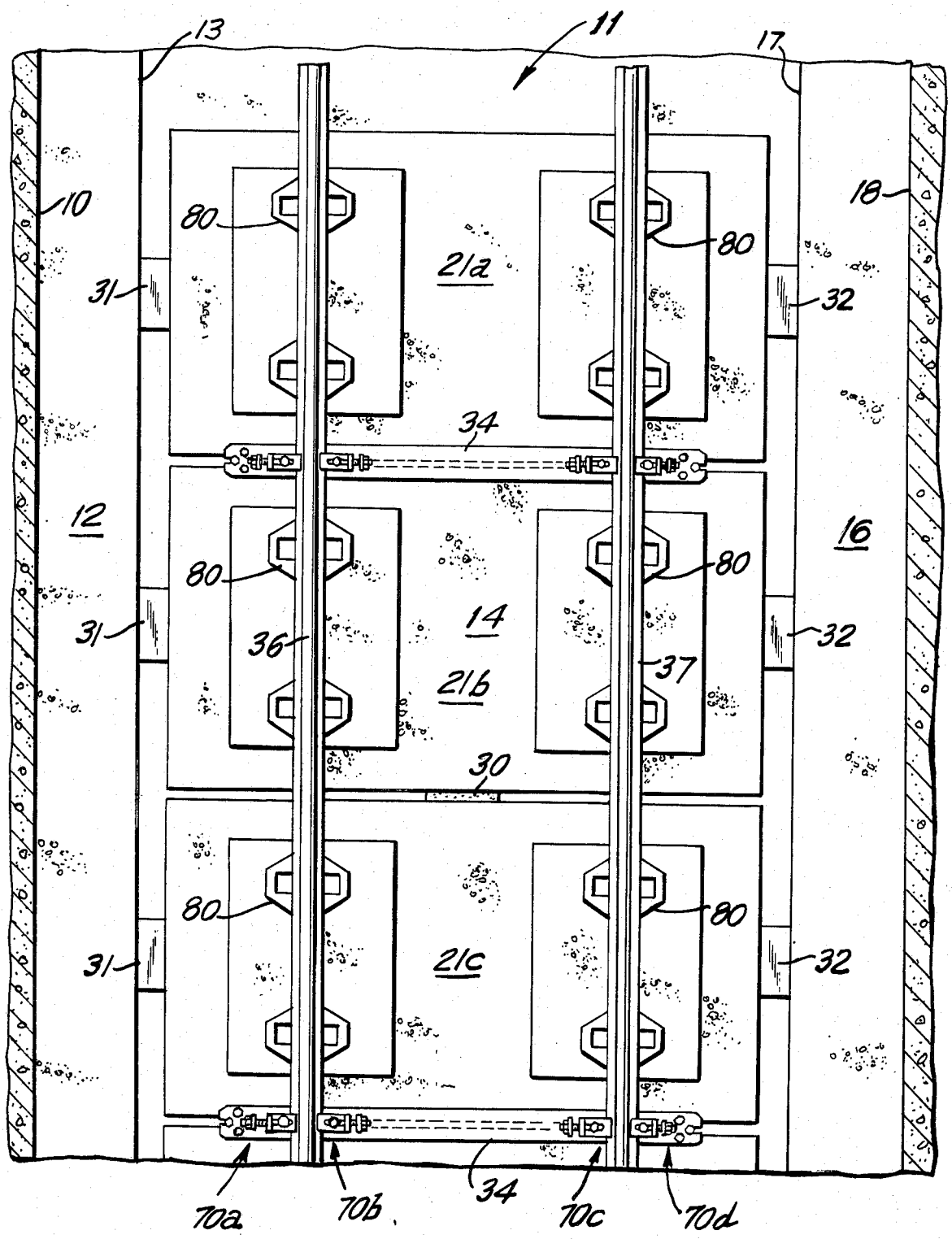
FIG. 3 is a top plan view of the rails and three slabs while the templates are in place over the slabs.

As illustrated in FIGS. 2 and 3, a tandem series of pre-cast side-by-side concrete slabs 21*a*, 21*b* and 21*c* are positioned along the length of the tunnel 11. Each concrete slab 21 rests on four vertical isolation pads 25 which are of a suitable resilient material such as an all natural rubber. The vertical isolation pads are preferably disk-like. A typical pre-cast concrete slab 21 would be about 1 ft. 2½ inches in thickness, about 4 ft. 6 inches in width and about 8 ft. 10½ inches in length, the length referring to the cross-width of the tunnel 11.

Each pre-cast concrete slab 21*a* is adapted to fit next to a matching concrete slab 21*b*. Each of the concrete slabs 21*a*, 21*b*, at its top face, has two elongated cavities, respectively 23 and 24. The cavities 23, 24 are adapted to be filled in with concrete.

As shown in FIG. 3, the concrete slabs 21 are separated from each other by longitudinal isolation pads 30. Similarly, the concrete slabs are separated from the walkway 12 and the raceway 16 by lateral isolation pads, respectively 31 and 32. The isolation pads 30, 31, 32, like the isolation pads 23, are preferably of an all natural rubber material.

Figure 4:
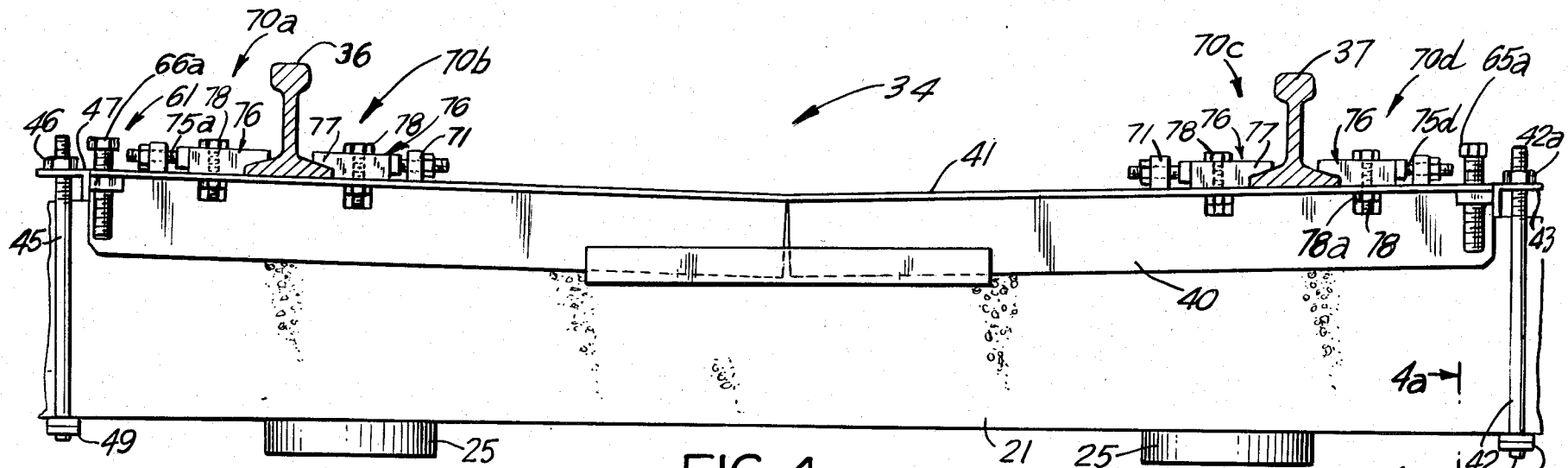
FIG. 4 is a side plan view of the gauge beam utilized in the present invention.

A series of gauge beams 34 are removably positioned over the level of the pre-formed concrete slabs and have threaded rods 42 and 45 at each end which hold the beams in place (see FIG. 4). The gauge beams temporarily hold the steel rails 36, 37 in their proper position with the proper gauge (separation), the appropriate elevation and the proper cant (inclination). The position of the tracks namely cant, elevation and gauge, are predetermined by surveying instruments and field engineers. The gauge beams 34 are located perpendicular to the direction of the rails, each gauge beam holds two rails and is preferably located at the longitudinal juncture between slabs.

Figure 5:
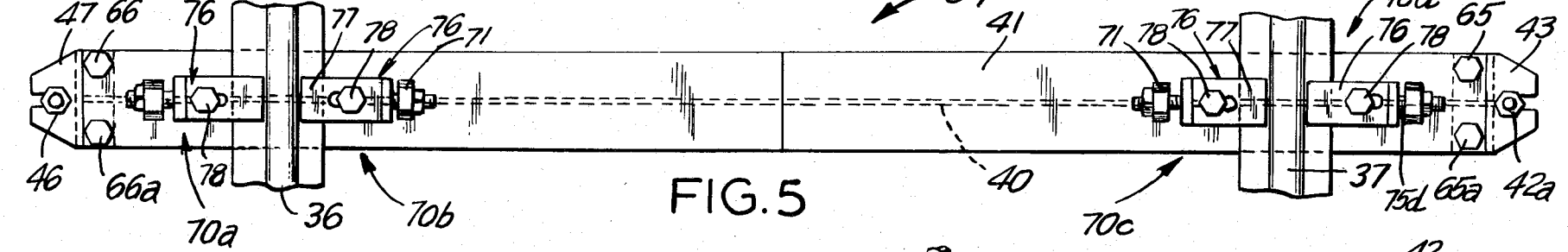
FIG. 5 is a top plan view of the gauge beam of FIG. 4.
Figure 4A:
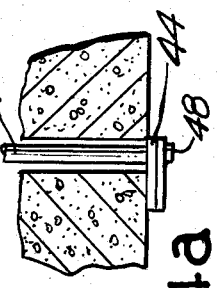
FIG. 4*a* is an enlarged view, partly in cross-section, of a portion of the gauge beam shown in FIG. 4
Figure 4B:
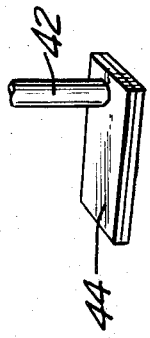
FIG. 4*b* is a perspective view of a portion of the gauge beam.

As shown in FIGS. 4 and 5, each gauge beam includes a vertically descending steel plate 40. A horizontally aligned steel plate 41 is welded, or otherwise fastened, to the plate 40, so that the plate 40 is centered relative to the plate 41. A screw-threaded rod 42 extends vertically from the edge 43 of the plate 41 and is connected thereto by the bolt 42*a*. The rod 42 has fixed thereto, at its lower free end, a rectangular foot member 44 which in top view is longer than wide and which is dropped between the slabs. The rod 42 is then turned 90 degrees, to bring its length dimension under the slabs, to thereby bring the foot member 44 into position, see FIG. 4*a*. The upper face of the rectangular foot member 44 is pulled against the bottom face of the slab. It is tightened to the slab by turning the nut 42*a*, so that the rectangular foot member 44 grips the underside of the slab. A similar screw-threaded rod 45 is attached by bolt 46 to the opposite end 47 of the gauge beam and has a similar bottom rectangular foot member 49 for engagement with the underside of the slab. The gauge beam is firmly fixed relative to the slab by tightening up on the bolts 42*a* and 46.

An adjustment means is provided on the gauge beam to adjust the rails held by the beam relative to the slabs. The height of the gauge beam and its cant, consequently the elevation and cant of the rails, is adjusted by rotation of the bolts 65, 65*a* on one end of the gauge beam and/or the bblts 66, 66*a* at the opposite end of the gauge beam.

If both sets of bolts 65, 65*a* and 66, 66*a* are turned in the same direction of rotation then the entire gauge beam is raised or lowered to adjust its height. However, if only one set of bolts 65, 65*a* or 66, 66*a* is turned, then only one end of the gauge beam will be raised or lowered, depending on the direction of turning, to thereby adjust the cant of the gauge beam.

The gauge, which is the distance between the rails, may also be adjusted by the adjustment means of the gauge beam.

As shown in FIGS. 4 and 5 two inside gauge adjustment assemblies 70*b*, 70*c* are provided on the gauge beam. Outside gauge beam adjustment assemblies, 70*a*, 70*d* connected to the gauge beam, are used, respectively, opposite assembly 70*b*, on the other side of the rail 36, and opposite assembly 70*c*, on the other side of the rail 36 (see FIG. 5).

As shown in FIGS. 4, 5, 6 and 7, each inside and outside gauge beam adjustment assembly 70*a*, 70*b*, 70*c* and 70*d* comprises a restrainer piece 76 having an integral rail hold-down nose portion 77 and an elongated slot 76*a* through which bolt 78 protrudes. The bolt 78, which is threaded into a nut 78*a* fixed to plate 41, is tightened down to lock the restrainer piece 76 to the plate 41 after it is adjusted. The restrainer piece 76 is moved sideways (toward or away from the rail) by rotation of bolt 75 which is threaded through the threaded block 71. The threaded block 71 is fixed to the horizontal plate 41 of the gauge beam.

As shown in FIGS. 4 and 5, clockwise rotation of the horizontal bolts in assemblies 70*b*, 70*d* will move the respective rails 36, 37 to the left (in relationship to those illustrations); and clockwise rotation of the horizontal bolts in the assemblies 70*a*, 70*c* will move the respective rails 36, 37 to the right.

Figure 11:
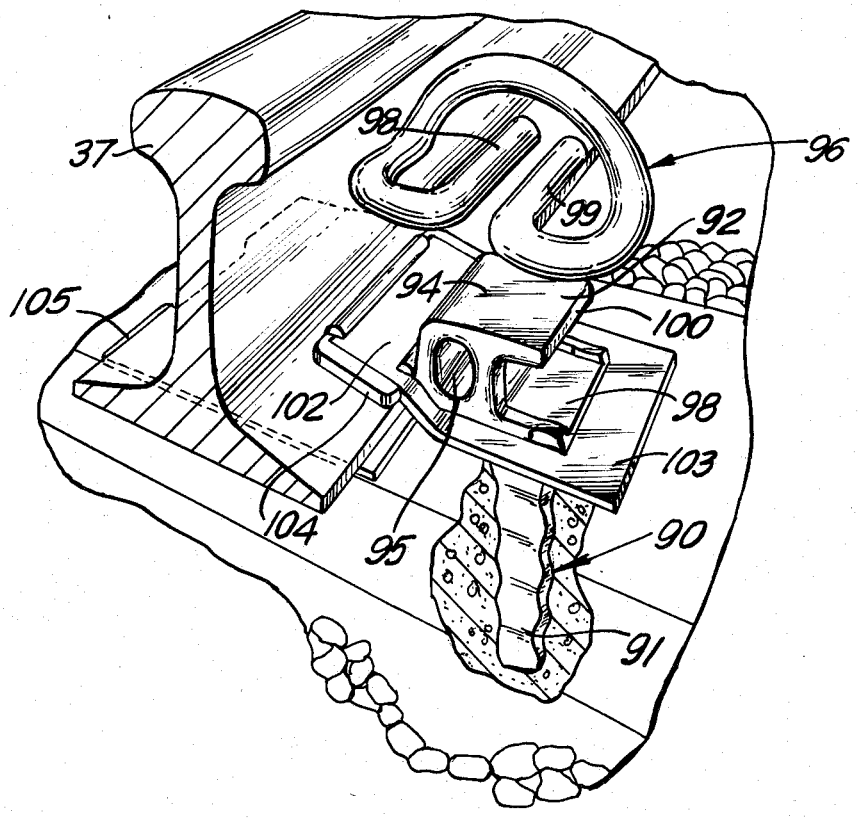
FIG. 11 is a perspective view of the rail fastening system which may be used in connection with the present invention.

The "Sidewinder" system, shown in FIG. 11 (trademark of Portec Inc., Oak Brook, Ill.) includes a shoulder-pin 90 having, as an integral portion, a descending pin portion 91 having opposed wavy indentation. The pin portion extends to a shoulder portion 92, above the concrete, having an upper platform-like gauge face 93 and an extension portion 94 having a hole therethrough. A spring clip 96 having an arced portion and inwardly extending arms 98, 99 is adapted to fit on the shoulder portion 92. One arm 98 fits in the hole 95 and the other arm 99 fits between face 93 and ledge portion 100. When the spring clip 96 is installed its outer arm bears downwardly on the face 102 of the plate 103. The plate 103 carries an external insulator pad 104 which bears against the rail flange. A resilient rubber rail tie pad 105 is positioned beneath the rail.

As shown in FIG. 8, a template 80, preferably a metal plate, is provided to locate the shoulder pins during the pouring of the concrete in the cavities 23, 24 (FIG. 1). The template 80 is a plate member 81 having four raised tabs 82*a–d* which exactly locate the template relative to a rail. The rail fits between the tabs 82*a*, 82*b* and also fits between the tabs 82*c* and 82*d*. The template 80 has four square holes 83 through which the shoulder-pins protrude and within which the shoulder-pins are temporarily secured. The template is only used to hold the shoulder-pins during the pouring of the concrete into the cavities 23, 24. The template is the same thickness as the resilient rubber pad 105. When the template is removed, the pad 105, is positioned beneath the rail. After the concrete has hardened, the templates are removed and replaced by the rubber pad 105, see FIG. 11.

Figure 10:
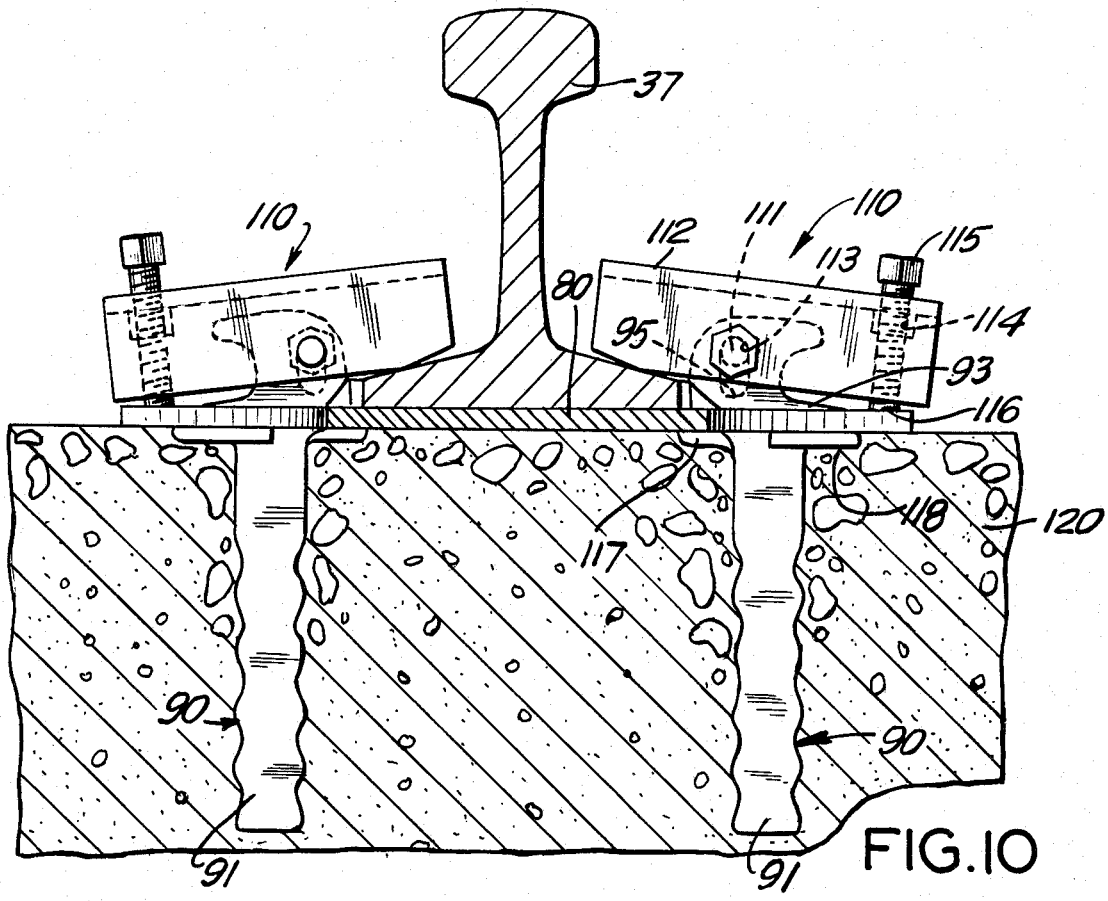
FIG. 10 is an enlarged view showing a cross-section of the portion of the track temporarily positioned on the template.

The rails 36, 37, held by the gauge beams 34 (FIG. 3), in effect, act as a position guide for the shoulder-pins 90 and the concrete poured into the cavities, see FIG. 10. After the rails 36, 37 have been positioned by the gauge beams 34 the shoulder-pins 90 and template 80 are removably secured to the rails by the clevis device 110 which is comprised of a pin 111, which acts as a pivot, and is fitted through the hole 95 in the shoulder-pin. An inverted "U" shaped plate 112 has opposed vertically elongated holes 113, through which the pin 111 fits, and a top screw-threaded bore 114, in which bolt 115 is threaded. The foot 116 of bolt 115 pushes against the top face of the template. The template 80 is held up, and positioned, by the flanges 117, 118 of the shoulder pin.

Figure 9:
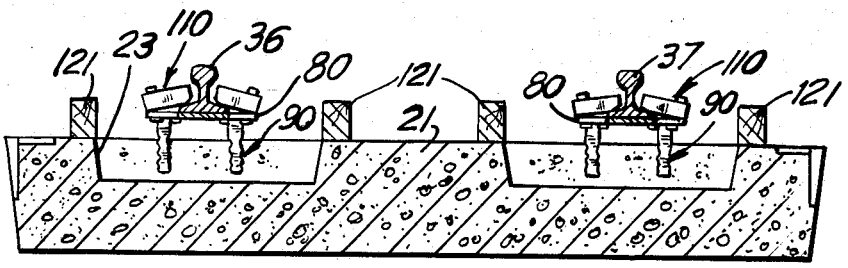
FIG. 9 is a cross-sectional view of the templates and shoulder pins removably attached to the rails prior to filling the slab cavities with concrete.

As shown in FIGS. 9 and 10, after the template 80 and shoulder-pins 90 are positioned in the air by the rail 37, the concrete is poured, filling the cavity 23, 24 (FIG. 2) up to the bottom face of the template 80. The rectangular wooden forms 121 provide removable walls to form the concrete. The height and cant of the concrete 120 in the cavity is determined by the template 80. For example, a typical concrete cavity fill 120 may be a quarter of a yard, 5000 psi, ⅜-inch aggregate concrete mix.

Figure 12:
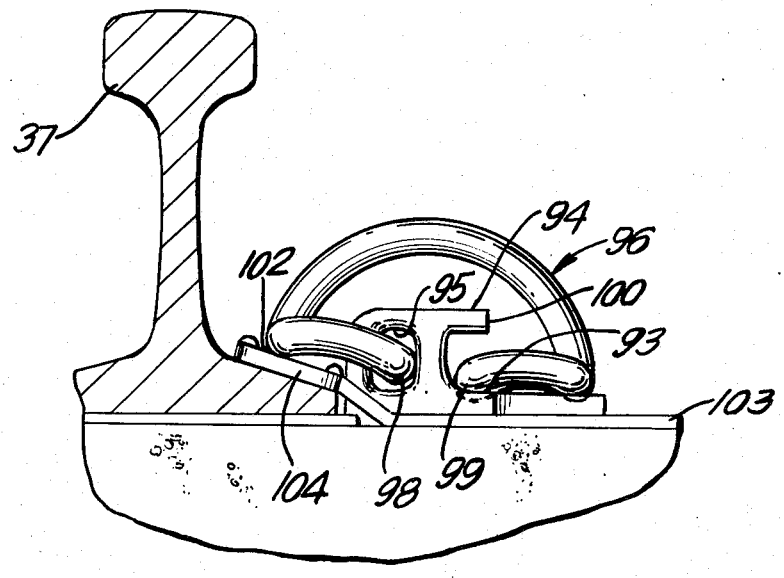
FIG. 12 is a side plan view, partly in cross-section, of the rail fastening system of FIG. 11.

The concrete 120 is allowed to harden firmly, holding the shoulder-pins in position. Then the wooden forms 121, the clevis devices 110, and the gauge beams 34 (FIG. 3) are removed and the rails 36, 37 are raised 2 or 3 inches. The rubber tie pads and an adhesive layer are applied to the top surface of the hardened concrete which fills the cavity beneath the rails. Then the rails are lowered onto the rail pads which rest on concrete cavity fill 120. The spring clips 96 are then secured to the shoulder-pins 90 in order to secure the rails 36, 37 in place (see also FIG. 12).

Modifications may be made in the present invention within the scope of the claims. For example, the concrete slabs may be omitted. The tunnel floor 14, shown in FIG. 1, may have an elogated groove (channel) along its length which, in effect, are used as a series of cavities in the same manner as the slab cavities, described above. The gauge beams are located above the groove and the track laid as in the case of the concrete slabs.

What is claimed is:

1. A method of laying a railroad track having parallel rails comprising the following sequence of steps:

(a) forming an elongated road bed for the track;

(b) positioning, in tandem, a series of preformed concrete slabs along the track bed, each of the slabs having a bottom face facing the track bed, and a top face with at least one cavity in its top face;

(c) locating a series of elongated gauge beams above the slabs, each gauge beam adapted to temporarily hold a pair of rails at the proper height, gauge and cant relative to the slab on which it is located, each gauge beam being aligned across the direction of the rails:

(d) positioning a pair or rails in the series of gauge beams and adjusting the rails to the said proper height, gauge and cant thereon by gauge beam adjustment means:

(e) removably positioning a template over the slab cavity:

(f) removably attaching a rail-holding shoulder pin, having a shoulder and a pin portion, to the template and to the rail so that the pin portion of the shoulder-pin is within the slab cavity and the template is held suspended above the cavity:

(g) pouring concrete into each cavity up to the bottom face of the template and letting the concrete harden to securely hold said pin portion;

(h) lifting the rails, removing the gauge beams and templates; and (i) lowering the rails and applying spring clips to the shoulder-pins so that the rails are gripped by the spring clips.

2. The method of laying a railroad track as in claim 1 and including the step, after step (h), of positioning a plurality of resilient vertical isolation pads beneath each slab to help dampen vibration and noise.

3. The method of laying a railroad track as in claim 1 and including the step, after step (b), of positioning longitudinal isolation resilient pads between the slabs.

4. The method of laying a railroad track as in claim 1 and including the step, as part of step (d), of adjusting the height and cant on said gauge means using a set of vertical bolts at opposite ends of said gauge beam which are pivotable to act against said slab.

5. The method of laying a railroad track as in claim 1 and including the step, as part of step (f), of removably attaching the shoulder-pin to said template by a pin and clevis device.

6. The method of laying a railroad track as in claim 1 wherein a rail pad is inserted between the rail and the concrete filling the cavity, after the concrete has hardened and before the rail is lowered.

7. A method of laying a railroad track having parallel rails, comprising the following steps in sequence:

(a) forming an elongated road bed for the track;

(b) forming (in tandem) a series of cavities along said road bed;

(c) locating a series of elongated gauge beams about the cavities, each gauge beam adapted to temporarily hold a pair of trcks and adjust the rails to the proper height, gauge and cant relative to the road bed on which it is located, each gauge beam being aligned across the direction of the rails;

(d) positioning a pair of rails in the series of gauge beams and adjusting the rails to the proper height, gauge and cant thereon by gauge beam adjustment means;

(e) positioning a template over each cavity;

(f) removably attaching a rail-holding shoulder pin, having a shoulder and a pin portion, to the template and to the rail so that the pin portion of the shoulder-pin is within the cavity and the template is held suspended above the cavity by the rail;

(g) pouring concrete into each cavity to securely hold said pin portion, letting the concrete harden;

(h) lifting the rails, removing the gauge beams and templates; and (i) lowering the rails and applying spring means to the rails to grip the rails, the spring means being held by the shoulder portion of said shoulder-pins.

* * * * *